US006694641B1

(12) United States Patent
Gill

(10) Patent No.: US 6,694,641 B1
(45) Date of Patent: Feb. 24, 2004

(54) FAST-STRAPPING SANDAL

(76) Inventor: Yoram Gill, 71a Horey Street, Haifa (IL), 34344

( * ) Notice: Subject to any disclaimer, the term of this patent is extended or adjusted under 35 U.S.C. 154(b) by 0 days.

(21) Appl. No.: 10/215,380

(22) Filed: Aug. 7, 2002

(30) Foreign Application Priority Data

Aug. 8, 2001 (IL) ..... 144803

(51) Int. Cl.[7] ..... A43B 3/12
(52) U.S. Cl. ..... 36/11.5; 36/50.1
(58) Field of Search ..... 36/11.5, 50.1

(56) References Cited

U.S. PATENT DOCUMENTS 2,259,273 A * 10/1941 Smith ..... 36/11.5
2,698,490 A * 1/1955 Goldman ..... 36/11.5
5,465,506 A * 11/1995 Matis et al. ..... 36/11.5
5,561,919 A * 10/1996 Gill ..... 36/11.5
5,659,982 A * 8/1997 Muraoka et al. ..... 36/50.1
5,836,090 A * 11/1998 Smith ..... 36/11.5
6,237,250 B1 * 5/2001 Aguerre ..... 36/11.5

* cited by examiner

*Primary Examiner*—Ted Kavanaugh
(74) *Attorney, Agent, or Firm*—William H. Dippert; Reed Smith LLP

(57) ABSTRACT

A fast-strapping sandal assembly comprising a sole assembly having a ball, arch and heel area and inward facing and outward facing portions; a heel engagement strap, adapted to support a wearer's heel; a main strap having a first end and a second end, the first end engaged to the sole assembly at the ball area on the inward portion of the sole assembly, the main strap extending through a loop associated with a first support post attached to the sole assembly at the outward facing portion of the sole assembly on the ball area and/or arch area, crossing over through a loop associated with a second support post attached to the sole assembly at the inward facing portion of the sole assembly near the anticipated ankle position of the wearer; and a fastening strap engaged to the sole assembly at the heel area and fasteningly engageable to the second end of the main strap, whereby a single tightening and fastening of the main strap is required to acquire fast and precise firm hold of the sandal to the wearer's foot.

14 Claims, 2 Drawing Sheets

FAST-STRAPPING SANDAL

FIELD OF THE INVENTION

The present invention relates to footwear. More particularly it relates to fast-strapping sandals.

BACKGROUND OF THE INVENTION

Sandals are considered the most basic footwear ever to exist, dating back thousands of years, and even mentioned in the bible. A great variety of sandals are described in the patent literature, some of which are mentioned hereinafter.

U.S. Pat. No. 736,194 describes a sandal with independently adjustable ankle and foot engagement strap assemblies. U.S. Pat. No. 2,421,818 describes a sandal vamp including multiple straps for retaining a sandal on a wearer's foot, only one of the straps being adjustable, U.S. Pat. No. 2,481,281 describes a sandal with elastic upper elements and U.S. Pat. No. 2,642,677 describes an adjustable counter for strap sandals including two independently adjustable ankle straps and a further independently adjustable toe strap.

U.S. Pat. No. 3,800,444 describes a laced sandal and a relatively rigid heel basket. U.S. Des. Pat. Nos. 94,639 and 166,025 illustrate various strap configurations for shoes and sandals.

U.S. Pat. Nos. 4,584,782 and 4,793,075 describe sport sandals with multi-layer soles and interconnected infinitely adjustable straps.

U.S. Pat. No. 5,533,278 describes a sandal with a cinch strap that extends from the toe strap to the heel cinch.

U.S. Pat. No. 6,237,250 describes a sandal with active self-adjusting harness, which adjusts itself in response to the foot movement relative to the sole.

U.S. Pat. No. 6,256,906 discloses a rather sophisticated hinged sandal strapping system.

U.S. Pat. No. 6,052,920 describes a sandal with X-cross weave straps for lateral support.

U.S. Pat. No. 5,561,919 describes sandal having independently adjustable straps. One embodiment shown in this patent comprises a sandal has a single strap extending from engagement located at the ball area through several loops and ending up wound around the wearer's calf.

It is an aim of the present invention to provide a fast-strapping sandal, which allows the wearer to fasten the sandal to his foot quickly and efficiently.

Another aim of the present invention is to provide a sandal with a fast-strapping mechanism that makes use of a single strap for tightening and fastening of the sandal to the wearer's foot.

Yet another aim of the present invention is to provide a fast-strapping sandal that assures good hold of the sandal to the foot and prevents or at least greatly reduces relative motion between the sandal and the foot.

Another aim of the present invention is to provide such sandal with continuous strapping mechanism allowing precise fitting to the foot.

Further aim of the present invention is to provide strapping mechanism that once fastened holds firmly and will not easily loosen.

Other features and advantages of the present invention will become apparent after reading the present specification and referring to the accompanying drawings.

BRIEF DESCRIPTION OF THE INVENTION

A main aspect of the present invention is the provision of a sandal with single strap continuous fastening mechanism.

It is an aim of the present invention to provide a fast-strapping sandal, which allows the wearer to fasten the sandal to his foot quickly and efficiently.

Another aim of the present invention is to provide a sandal with a fast-strapping mechanism that makes use of a single strap for tightening and fastening of the sandal to the wearer's foot.

Yet another aim of the present invention is to provide a fast-strapping sandal that assures good hold of the sandal to the foot and prevents or at least greatly reduces relative motion between the sandal and the foot.

Another aim of the present invention is to provide such sandal with continuous strapping mechanism allowing precise fitting to the foot.

Further aim of the present invention is to provide a sandal with fast strapping mechanism that once fastened holds firmly and will not loosen easily even under extreme water-sport activity conditions.

It is therefore thus provided, in accordance with a preferred embodiment of the present invention, a fast-strapping sandal assembly comprising:

a sole assembly having a ball, arch and heel area and inward facing and outward facing portions;

a heel engagement strap, adapted to support a wearer's heel;

a main strap having a first end and a second end, the first end engaged to the sole assembly at the ball area on the inward portion of the sole assembly, the main strap extending through a loop associated with a first support post attached to the sole assembly at the outward facing portion of the sole assembly on the ball area and/or arch area, crossing over through a loop associated with a second support post attached to the sole assembly at the inward facing portion of the sole assembly near the anticipated ankle position of the wearer; and a fastening strap engaged to the sole assembly at the heel area and fasteningly engageable to the second end of the main strap, whereby a single tightening and fastening of the main strap is required to acquire fast and precise firm hold of the sandal to the wearer's foot.

Furthermore, in accordance with another preferred embodiment of the present invention, the second end of the main strap is coupled to a ladder lock buckle adapted to fasteningly engage to the fastening strap.

Furthermore, in accordance with another preferred embodiment of the present invention, the heel support strap is fixed in length.

Furthermore, in accordance with another preferred embodiment of the present invention, the heel support strap is adjustable.

Furthermore, in accordance with another preferred embodiment of the present invention, the heel support strap is passed through loops provided on the second support post and the fastening strap at a predetermined height over the sole, so as to present the heel support strap substantially at the back depression over the heel of the wearer.

Furthermore, in accordance with another preferred embodiment of the present invention, the sole assembly comprises a multi-layered sole.

Furthermore, in accordance with another preferred embodiment of the present invention, the sole assembly is made of three principal layers.

Furthermore, in accordance with another preferred embodiment of the present invention, the sole assembly has a bottom layer formed of a high friction abrasion resistant material such as rubber and is formed with a bottom surface, which is conditioned for good grip on a support surface.

Furthermore, in accordance with another preferred embodiment of the present invention, the sole assembly has a light-weight shock absorbing intermediate layer made from foamed plastic material such as EVA.

Furthermore, in accordance with another preferred embodiment of the present invention, the intermediate layer is formed with at least one and preferably a plurality of optional cut-outs extending entirely through the intermediate layer at locations interiorly therewith, and wherein the intermediate layer is sealed such that each of cut-outs defines a hermetically sealed air pocket.

Furthermore, in accordance with another preferred embodiment of the present invention, an arch support is included in the sole assembly.

Furthermore, in accordance with another preferred embodiment of the present invention, a top layer of the sole assembly is formed with three pairs of apertures, two pairs of substantially opposite apertures positioned laterally at the heel area and arch area, and a third pair of apertures positioned laterally at the ball area, in a gradual alignment, where one aperture at the top surface of the sole assembly near the inward facing portion of the sandal is slightly in front of the second aperture, positioned on top of the sole near the outward facing portion.

Furthermore, in accordance with another preferred embodiment of the present invention, a top layer of the sole assembly is formed with a top surface having high friction coefficient coarse texture and provided with anti-bacterial additive.

Finally, in accordance with another preferred embodiment of the present invention, the sandal assembly is further provided with a toe-stabilizing strap for augmented grip of the sandal to the foot.

BRIEF DESCRIPTION OF THE FIGURES

In order to better understand the present invention, and appreciate its practical applications, the following Figures are provided and referenced hereafter. It should be noted that the Figures are given as examples only and in no way limit the scope of the invention as defined in the appending Claims. Like components are denoted by like reference numerals.

DETAILED DESCRIPTION OF THE INVENTION AND FIGURES

Figure 1:
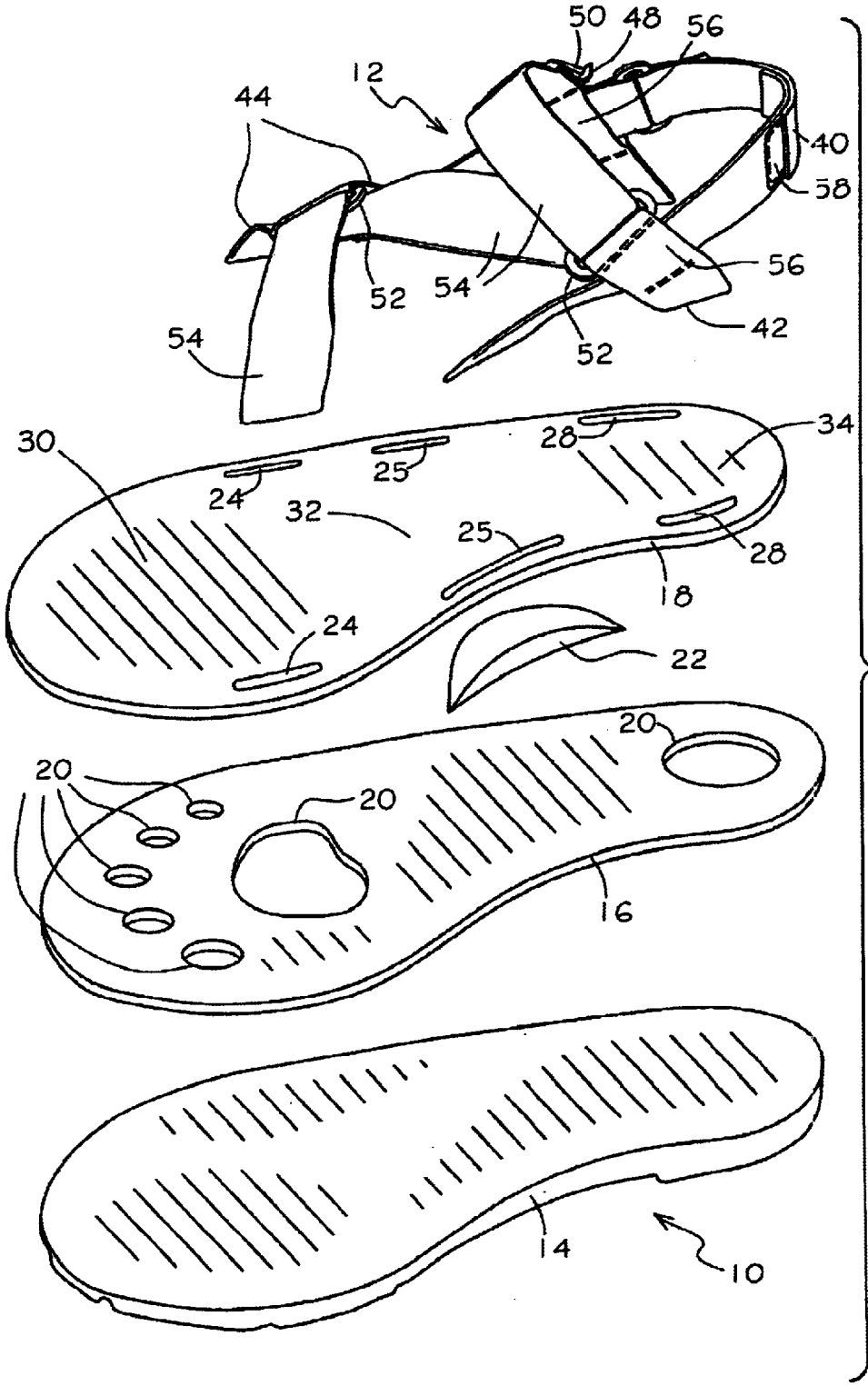
FIG. 1 illustrates an exploded view of a fast-strapping sandal in accordance with a preferred embodiment of the present invention.

The present invention is hereinafter explained with reference to the accompanying figures. Reference is now made to FIG. 1, illustrating an exploding view of a fast-strapping sandal in accordance with a preferred embodiment of the present invention.

Figure 2:
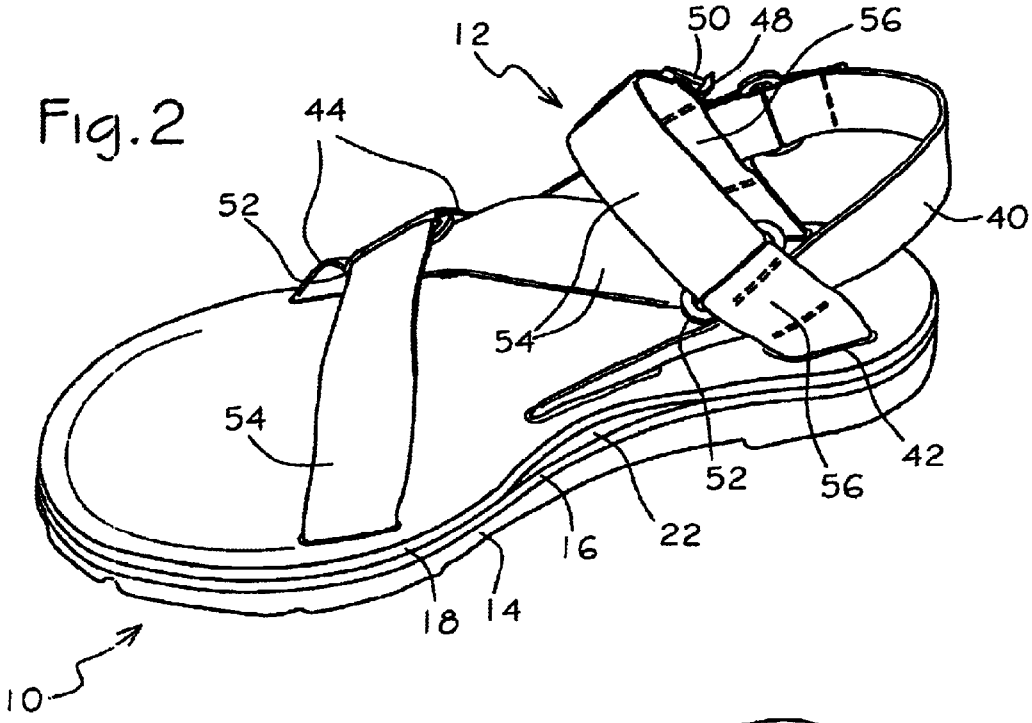
FIG. 2 illustrates an isometric view of a fast-strapping sandal in accordance with a preferred embodiment of the present invention.

As seen in FIGS. 1 and 2, the sandal defines a sole assembly, indicated generally by reference numeral 10, and a foot engagement assembly, indicated generally by reference numeral 12.

In accordance with a preferred embodiment of the present invention, the sole assembly 10 comprises three principal layers 14, 16 and 18. Bottom layer 14 preferably is formed of a high friction and abrasion resistant material such as rubber and is formed with a bottom surface which is conditioned for good grip on a support surface. An intermediate layer 16 may be formed of a suitable light-weight and sock absorbing material, such as EVA.

In accordance with a preferred embodiment of the present invention, the intermediate layer 16 is formed with at least one and preferably a plurality of optional cut-outs 20. Cut-outs 20 are holes extending entirely through the intermediate layer 16 at locations interiorly therewith. Preferably the cut-outs are defined together with the overall configuration of the intermediately layer 16 by die cutting or any other equivalent technique and thus the formation of cut-outs 20 normally does not require any additional step.

One or more additional support elements such as an arch support 22 or a heel support (not shown) may be included in the sole assembly, as shown.

A top layer 18 is preferably formed with three pairs of apertures 24, 26, 28, two pairs (26, 28) of substantially opposite apertures—positioned laterally at the heel area 34 and arch area 32 of the sandal, and a third pair of apertures positioned laterally at the ball of the sandal 30, in a gradual alignment, where one aperture at the top surface of the sole near the inward facing side of the sandal (the side that faces the other sandal when both are worn) slightly in front of the second aperture, positioned on top of the sole near the outward facing side. The apertures are provided for accommodating straps forming part of foot engagement assembly 12. In accordance with a preferred embodiment of the present invention top layer 18 is formed with a material suitable for foot contact, having high friction coefficient coarse texture and provided with anti-bacterial additive.

The three layers 14, 16 and 18 of the sole assembly are sealed together, alone or in combination with additional inserts or additional layers. In accordance with a preferred embodiment of the present invention, intermediate layer 16 is sealed such that each of cut-outs 20 defines a hermetically sealed air pocket. Thus in accordance with a preferred embodiment of the present invention, any suitable desired number of air pockets may be readily defined in the sole assembly substantially without additional manufacturing costs. Accordingly, air pockets may be defined at the region of the individual toes, the ball of the foot and the heel or at any other desired location.

Figure 3:
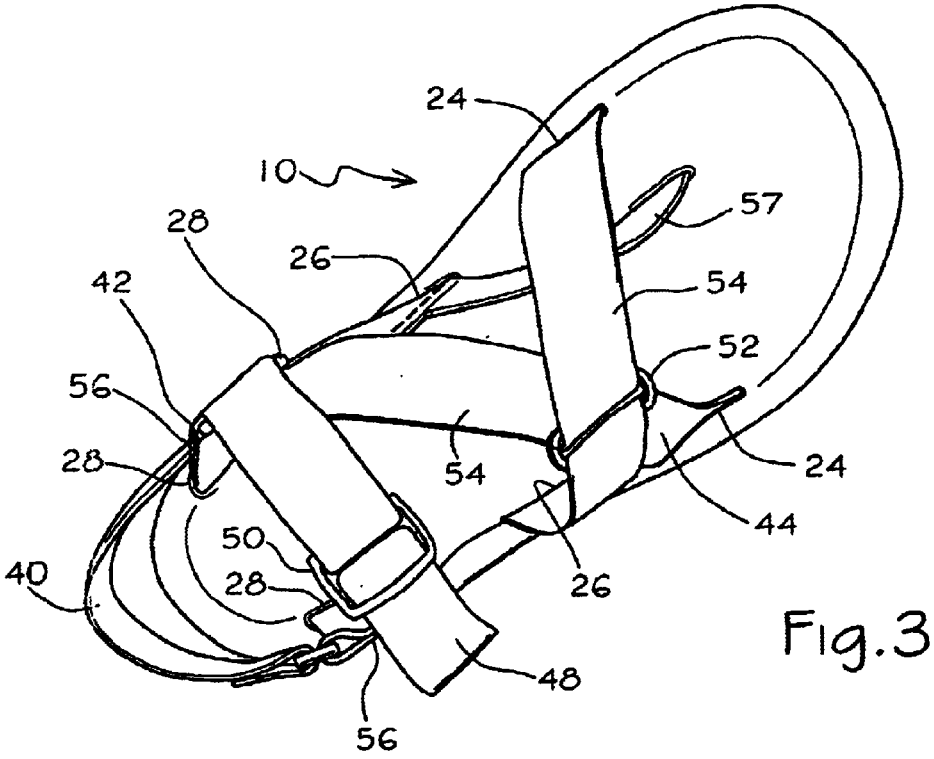
FIG. 3 illustrates a top view a fast-strapping sandal in accordance with a preferred embodiment of the present invention.

Reference is now made to FIGS. 2 and 3, which illustrate a preferred strap configuration for a fast-strapping sandal in accordance with a preferred embodiment of the present invention. It is appreciated that although this strap configuration is also shown in FIG. 1, the sole construction described above is not limited to use with sandals or with a particular configuration of sandals shown in FIGS. 1, 2 and 3, and in fact any sole assembly may be used in conjunction with the sandal of the present invention.

In the embodiments shown in FIGS. 1, 2 and 3 the foot engagement assembly comprises a heel engagement strap 40 (which may be fixed in length as in the embodiments shown in FIG. 2 and 3, and adjustable in its length by a hook and loop closure 58 as in the embodiment shown in FIG. 1), supporting the back of the ankle of the wearer, a main strap 54, a front support post 44 and rear support post 42. Main strap 54 is engaged to the sole at the inward portion of the sole through the ball aperture, extending through loop 52 associated with support post 44 located on the top sole near the outward portion of the sole at the ball and/or arch area, crossing over to loop 52 associated with support post 42 located on the top sole near the inward facing portion of the sole near the anticipated ankle position, and engaging to ladder lock 50, through which fastening strap 48 is engaged and fastened. By pulling the main strap and adjusting it tightly (yet conveniently) over the wearer's foot, and fastening the main strap 54 by pulling tight the fastening strap 48 and locking it by the ladder lock buckle 50, the sandal is secured tightly to the wearer's foot.

It is noted that support post 42 is attached to the sole at heel aperture 28, but extends so that loop 52 is positioned over the arch area of the sole near the wearer's ankle. The heel engagement strap 40 may be fixed in length (as shown in the figures) or adjustable. Support post 44 is preferably a strap with a loop 52 attached to sole 10 at one end through ball aperture 24 and at its other end through arch aperture 26 (both on the outward facing side of the sole. It is alternatively possible to provide a support post attached to the sole at aperture 24 only, or at aperture 26 only.

Heel support strap 40 and main strap 54 are not interconnected, for better securing, strapping and fitting, but optionally heel support strap 40 may be passed through loops 56 provided on the strap of support post 42 and fastening strap 48, at a predetermined height over the sole. This arrangement is not aimed at limiting the independent fastening of each strap to the dynamic flex of the foot, for the fastened straps are adjusted longitudinally, whereas loops 56 limit the lateral motion of the straps, thus holding the heel support at a predetermined height above the sole so as to present it substantially at the back depression over the heel of the wearer, for convenient use.

An optional toe-stabilizing strap 57 (see FIG. 3) may be provided for augmented grip of the sandal to the foot.

The use of a ladder lock buckle ensures precise fitting and fastening of the sandal to the wearer's foot, for the engagement is continuous and not discrete, such as engagement employing a buckle. Furthermore, ladder lock buckle is particularly suitable for wet activities, where the wearer's feet are submerged in water or heavily splashed, where other fastening means such as hook and loop closure such as Velcro® are inefficient and can easily accidentally cause loosening of the strapping and subsequently losing of the sandal. However the sandal of the present invention is not limited to ladder lock engagement only, and other engagement means such as a buckle, Velcro® engagement means and other means, may be used.

The sandal of the present invention has a particular appeal for outdoor activities. It is easy to fit and quick to fasten, and provides secured engagement of the sandal to the wearer's foot, preventing or at least greatly reducing relative displacement between the sandal and the foot. The sandal of the present invention provides reliable foot support thus reducing feet friction-induced or lack-of-support injuries, such as blisters, cuts and bruises.

The unique arrangement of the strap assembly of the sandal ensures fast-strapping while at the same time providing convenient footwear that easily adapts itself to the individual foot form, for the correct positioning of the support posts is important to prevent uncomfortable feel of the sandal to the wearer.

It should be clear that the description of the embodiments and attached Figures set forth in this specification serves only for a better understanding of the invention, without limiting its scope as covered by the following Claims.

It should also be clear that a person skilled in the art, after reading the present specification could make adjustments or amendments to the attached figures and above described embodiments that would still be covered by the following claims.

What is claimed is:

1. A fast-strapping sandal assembly comprising:

a sole assembly having a ball, arch and heel area and inward facing and outward facing portions;

a heel engagement strap, adapted to support a wearer's heel;

a main strap having a first end and a second end, the first end engaged to the sole assembly at the ball area on the inward portion of the sole assembly, the main strap extending through a loop associated with a first support post attached to the sole assembly at the outward facing portion of the sole assembly on the ball area and/or arch area, crossing over through a loop associated with a second support post attached to the sole assembly at the inward facing portion of the sole assembly near the anticipated ankle position of the wearer; and a fastening strap engaged to the sole assembly at the heel area and fasteningly engageable to the second end of the main strap, whereby a single tightening and fastening of the main strap is required to acquire fast and precise firm hold of the sandal to the wearer's foot.

2. The sandal assembly according to claim 1, wherein the second end of the main strap is coupled to a ladder lock buckle adapted to fasteningly engage to the fastening strap.

3. The sandal assembly according to claim 1, wherein the heel support strap is fixed in length.

4. The sandal assembly according to claim 1, wherein the heel support strap is adjustable.

5. The sandal assembly of claim 1, wherein the heel support strap is passed through loops provided on the second support post and the fastening strap at a predetermined height over the sole, so as to present the heel support strap substantially at the back depression over the heel of the wearer.

6. The sandal assembly according to claim 1, wherein the sole assembly comprises a multi-layered sole.

7. The sandal assembly according to claim 1, wherein the sole assembly is made of three principal layers.

8. The sandal assembly according to claim 7, wherein the sole assembly has a bottom layer formed of a high friction abrasion resistant material such as rubber and is formed with a bottom surface, which is conditioned for good grip on a support surface.

9. The sandal assembly according to claim 7, wherein the sole assembly has a light-weight shock absorbing intermediate layer made from foamed plastic material such as EVA.

10. The sandal assembly according to claim 9, wherein the intermediate layer is formed with at least one and preferably a plurality of optional cut-outs extending entirely through the intermediate layer at locations interiorly therewith, and wherein the intermediate layer is sealed such that each of cut-outs defines a hermetically sealed air pocket.

11. The sandal assembly according to claim 7, wherein an arch support is included in the sole assembly.

12. The sandal assembly according to claim 7, wherein a top layer of the sole assembly is formed with three pairs of apertures, two pairs of substantially opposite apertures positioned laterally at the heel area and arch area, and a third pair of apertures positioned laterally at the ball area, in a gradual alignment, where one aperture at the top surface of the sole assembly near the inward facing portion of the sandal is slightly in front of the second aperture, positioned on top of the sole near the outward facing portion.

13. The sandal assembly according to claim 7, wherein a top layer of the sole assembly is formed with a top surface having high friction coefficient coarse texture and provided with anti-bacterial additive.

14. The sandal assembly according to claim 1, wherein it is further provided with a toe-stabilizing strap for augmented grip of the sandal to the foot.

* * * * *